US008599021B2

(12) United States Patent
Belden, Jr. et al.

(10) Patent No.: US 8,599,021 B2
(45) Date of Patent: Dec. 3, 2013

(54) METHOD AND APPARATUS FOR DEACTIVATING AN ALARMING UNIT

(71) Applicant: Checkpoint Systems, Inc., Thorofare, NJ (US)

(72) Inventors: Dennis D. Belden, Jr., Canton, OH (US); Michael Rapp, Modautal (DE)

(73) Assignee: Checkpoint Systems, Inc.

( * ) Notice: Subject to any disclaimer, the term of this patent is extended or adjusted under 35 U.S.C. 154(b) by 0 days.

(21) Appl. No.: 13/788,588

(22) Filed: Mar. 7, 2013

(65) Prior Publication Data

US 2013/0181837 A1 Jul. 18, 2013

Related U.S. Application Data

(63) Continuation of application No. 12/945,980, filed on Nov. 15, 2010, now Pat. No. 8,405,507.

(51) Int. Cl.
*G08B 13/14* (2006.01)

(52) U.S. Cl.
USPC ..... 340/568.2; 340/568.1; 340/568.8; 340/571

(58) Field of Classification Search
USPC ..... 340/568.1, 568.2, 568.8, 571, 572.1, 340/539.1, 572.8, 572.9; 312/215, 218, 312/220, 221
See application file for complete search history.

(56) References Cited

U.S. PATENT DOCUMENTS

| | | | | |
|---|---|---|---|---|
| 4,693,655 | A | 9/1987 | Omori | |
| 7,053,774 | B2 * | 5/2006 | Sedon et al. | 340/568.2 |
| 7,626,500 | B2 | 12/2009 | Belden et al. | |
| 7,659,817 | B2 | 2/2010 | Conti et al. | |
| 7,724,135 | B2 * | 5/2010 | Rapp et al. | 340/568.1 |
| 8,106,772 | B2 | 1/2012 | Irmscher et al. | |
| 8,162,262 | B2 | 4/2012 | Kutzmann et al. | |
| 2005/0184857 | A1 | 8/2005 | Roatis et al. | |
| 2008/0068163 | A1 | 3/2008 | Nagelski et al. | |
| 2009/0033492 | A1 | 2/2009 | Rapp et al. | |
| 2010/0188222 | A1 | 7/2010 | Irmscher et al. | |

* cited by examiner

*Primary Examiner* — Toan N Pham

(57) ABSTRACT

A system and method for displaying merchandise item is presented. A merchandise display system includes a display cabinet, an alarm unit and a key extension device. The display cabinet can display several different kinds of merchandise items. The alarm unit generates an alarm when one of the merchandise items is removed from a predetermined distance from the display cabinet. The key extension device can be mounted on the display cabinet away from the alarm unit to allow an electronic key to be inserted into the key extension devise to control the alarm unit.

20 Claims, 7 Drawing Sheets

METHOD AND APPARATUS FOR DEACTIVATING AN ALARMING UNIT

CROSS REFERENCE TO RELATED APPLICATION

This application is a continuation of U.S. patent application Ser. No. 12/945,980, filed Nov. 15, 2010 (now U.S. Pat. No. 8,405,507); the disclosure of which is incorporated herein by reference.

BACKGROUND OF THE INVENTION

1. Field of Invention

The current invention relates generally to apparatus, systems and methods for displaying items of merchandise. More particularly, the apparatus, systems and methods relate to displaying items on a cabinet or some other structure in a commercial environment. Specifically, the apparatus, systems and methods provide for a way to activate or deactivate an alarm unit without requiring access to an interior chamber of a display cabinet or some other structure in a commercial environment.

2. Description of Related Art

The surveillance of freely presented objects to protect them against theft by means of a sensor that is connected to a monitoring and alarm device via an electrical line is known in the art. Such items are commonly displayed on a counter or other structure for viewing by prospective purchasers. When the line or the anti-theft installation is manipulated or the sensor is removed, the monitoring and alarm device sets off an audible and visual alarm. It has been proposed to provide a method, system and an apparatus which enables specific, reliable surveillance of the displayed object and requiring a comparatively small outlay, particularly in equipment and installation, by providing an audible alarm at the counter or a visual alarm at a display device when the item is attempted to be removed. Particularly, electronic products in the fields of information technology and audio/video equipment are as a rule freely presented in substantial quantities. When a theft alarm is set off, it is therefore difficult to be able to locate the site of the theft promptly. It can be difficult for store employees to quickly turn off an alarm once the alarm has been activated or erroneously activated. Thus, a better alarm system for protecting items of merchandise on display in commercial settings may be desired.

SUMMARY OF THE INVENTION

In one aspect, the invention may provide a system comprising: a display cabinet configured to display a plurality of merchandise items; a plurality of tethers, wherein each tether is configured to be attached to a respective merchandise item; an alarm unit configured to generate an alarm in response to one of the merchandise items being removed from a respective tether or in response to a respective tether being cut; and a key extension device configured to be mounted away from the alarm unit and on an outer surface of the display cabinet, the key extension device being configured to carry signals from an electronic device to the alarm unit to control the alarm unit without opening the display cabinet.

In another aspect, the invention may provide an apparatus comprising: a plurality of tethers, wherein the plurality of tethers includes a tether configured to be attached to a merchandise item to be displayed on a display cabinet; an alarm unit configured to be placed inside the display cabinet and connected to the plurality of tethers, the alarm unit being further configured to generate an alarm in response to the merchandise item being removed from the tether or in response to the tether being cut; an electronic device configured to provide signals that control the alarm unit; and a key extension device configured to carry the signals from the electronic device to the alarm unit to control the alarm unit without opening the display cabinet.

In another aspect, the invention may provide an apparatus comprising a key extension cabinet portion configured to be mounted on another surface of a display cabinet and away from an alarm unit that is placed inside the display cabinet; wherein the alarm unit is configured to generate an alarm in response to any one of a plurality of merchandise items being removed from a respective tether or in response to any one of a plurality of tethers being cut; and a key extension cable configured to be connected between the key extension cabinet portion and the alarm unit to carry signals from an electronic device to the alarm unit to control the alarm unit without opening the display cabinet.

BRIEF DESCRIPTION OF SEVERAL VIEWS OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
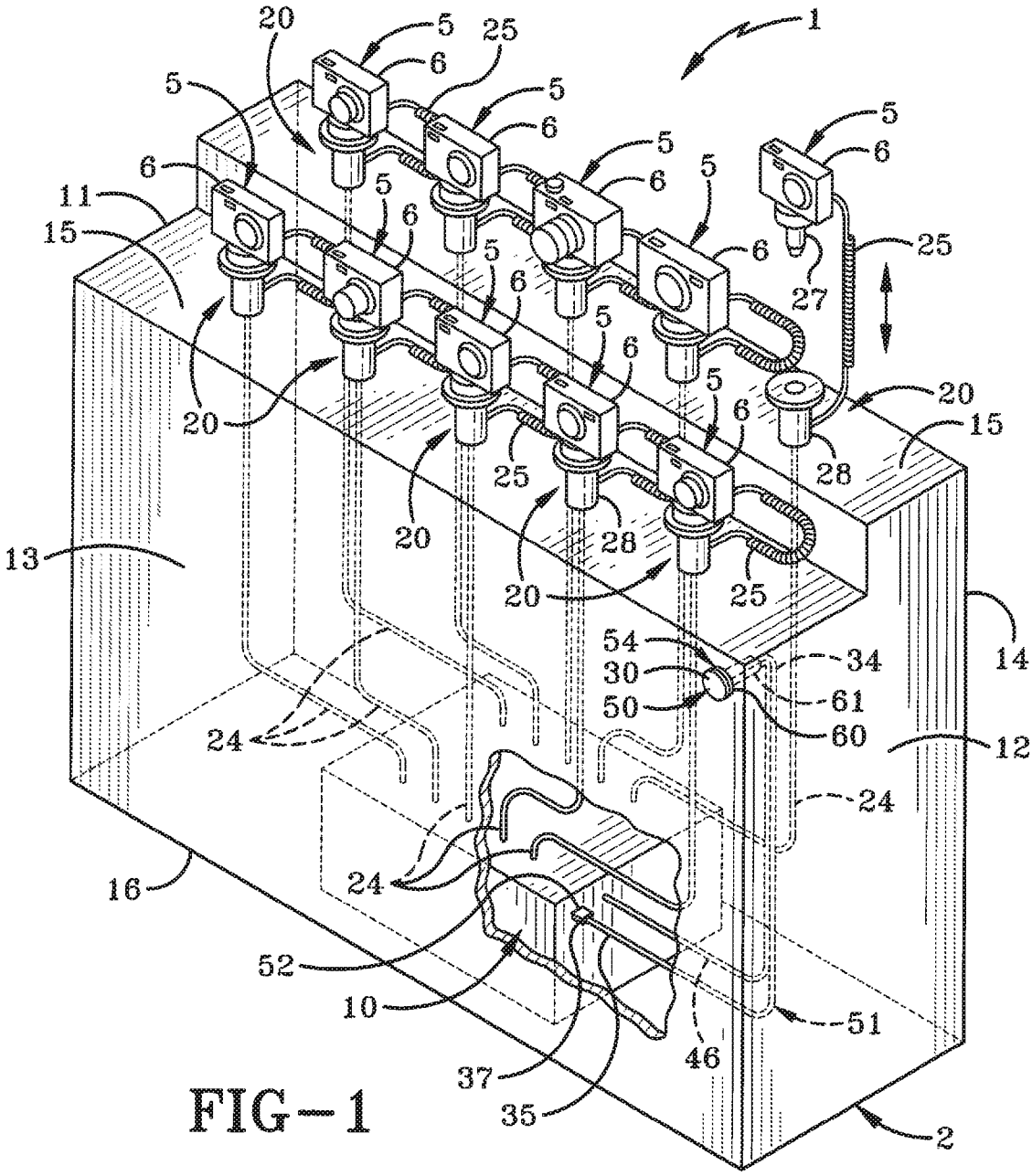
FIG. 1 illustrates a preferred embodiment of a key extension device for deactivating an alarm unit installed in a cabinet.

FIG. 1 illustrates the preferred embodiment of a merchandise display system used to protect merchandise items 5. The system 1 includes an alarm unit 10 and a key extension device 50. The alarm unit 10 can be placed inside a display cabinet 2. The display cabinet 2 includes a plurality of walls forming an enclosed chamber for receiving the alarm unit 10. For example, the display cabinet 2 can be formed with a left wall 11, a right wall 12, a front wall 13, a back wall 14, a top wall 15, and a bottom wall 16. The display cabinet 2 can be formed with multiple levels of top walls as shown in FIG. 1 to better display more than one row of merchandise items 5. An access door can be formed in the back wall 14 or another wall that can be locked. Locking the access door prevents unwanted tampering with the alarm unit 10 by non-authorized personnel.

Figure 12:
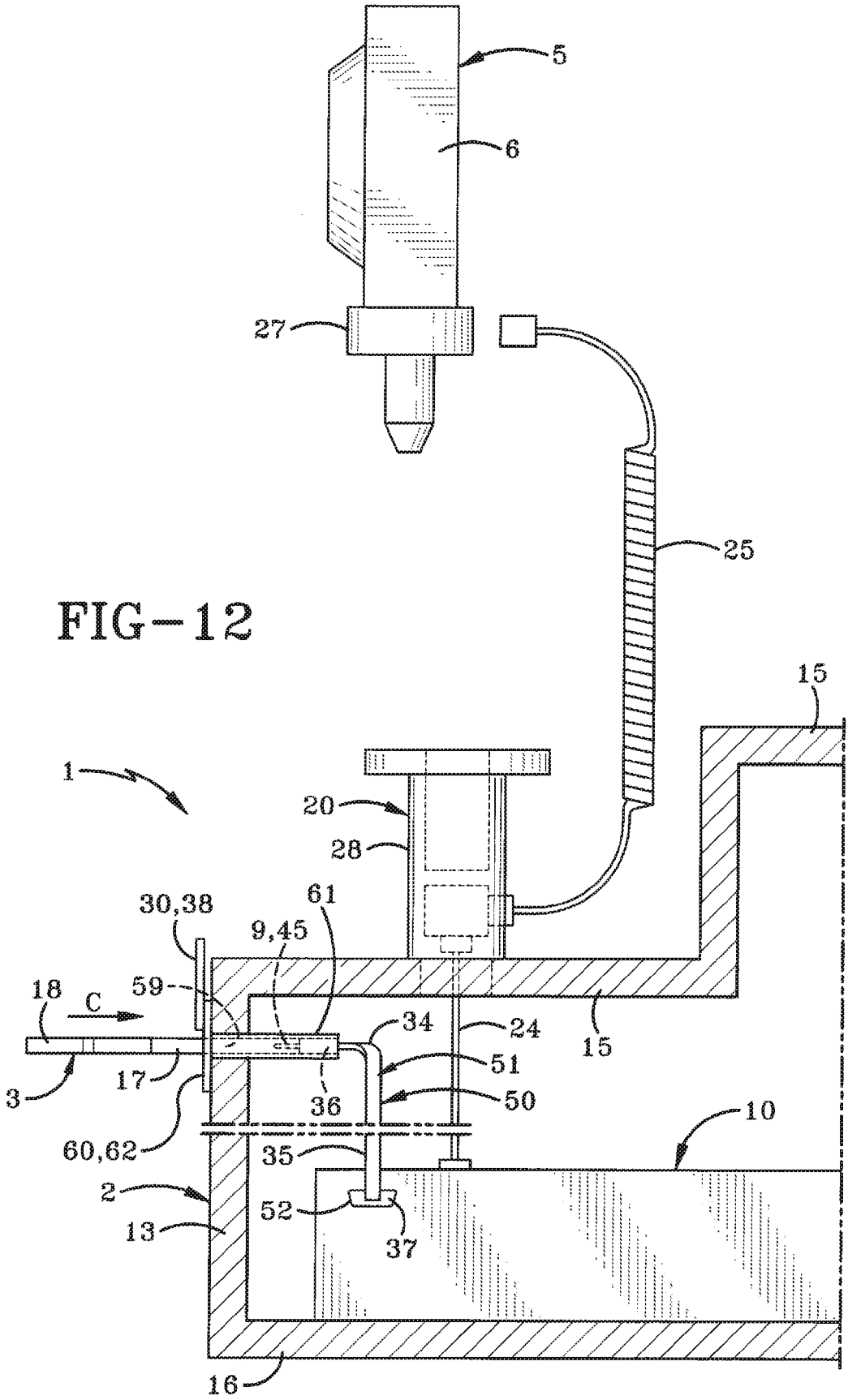
FIG. 12 illustrates a side view of a display stand with the preferred embodiment of the key extension device installed in the display cabinet.

Merchandise items 5 may be displayed on pedestal structures 20 attached to the top wall 15 of the display cabinet 2. For example, the display structure 27 can be configured to support cameras 7, personal digital assistants, cellular telephones, other electronic devices and the like. The merchandise items 5 can each be attached to a tether 24 that is connected to the alarm unit 10. The tether 24 allows a customer to pick up a merchandise item 5 and to view and inspect that item when deciding whether to purchase the item. Those of ordinary skill in the art will realized that the tether 24 could be attached to a recoiler that automatically recoils the tether 24 into the recoiler when the item is returned to its pedestal structure 20. Additionally, an attachment device 27 can be attached to the merchandise item 5 and a tether 24 can be connected to the attachment device 27 as is best seen in FIG. 12. In another configuration of the preferred embodiment, the tether 24 can be connected to a pedestal base 28 with a coiled wire 25 attached between the base 28 and the attachment device 27 with the coiled wire 25 in electrical communication with the tether 24.

The key extension device 50 is configured to be mounted on the display cabinet 2 away from the alarm unit 10. The key extension device 50 allows an electronic key 3 to be inserted into the key extension devise 50 to control the alarm unit 10. This makes it easier for an authorized store employee to control the alarm unit 10 rather than requiring the employee to unlock the cabinet 2 to insert the electronic key 3 into an electronic key socket 52 in the alarm unit 10.

Figure 2:
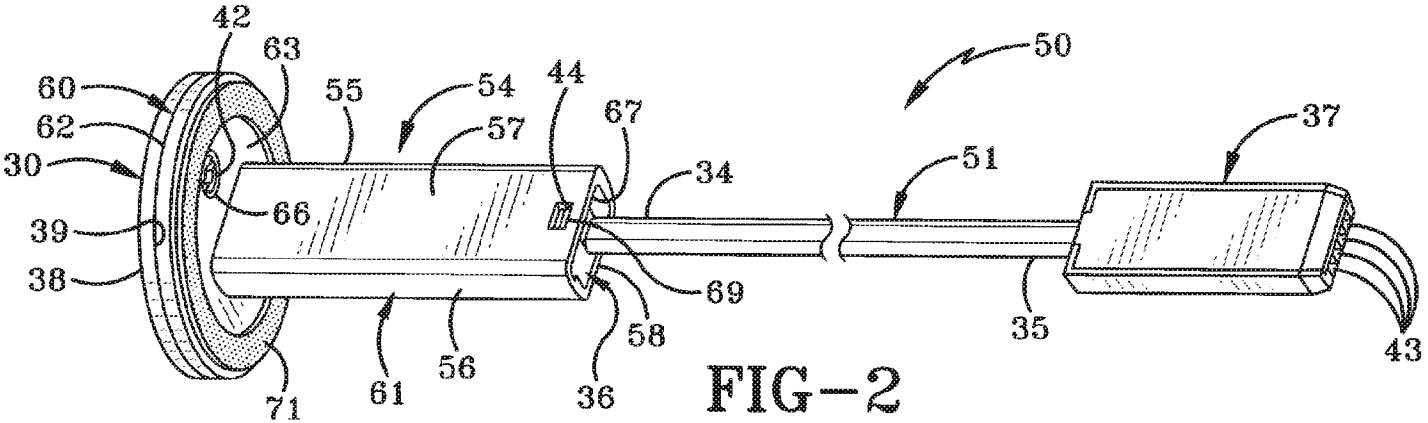
FIG. 2 illustrates a perspective view of the preferred embodiment of the key extension device for deactivating an alarm unit.
Figure 3:
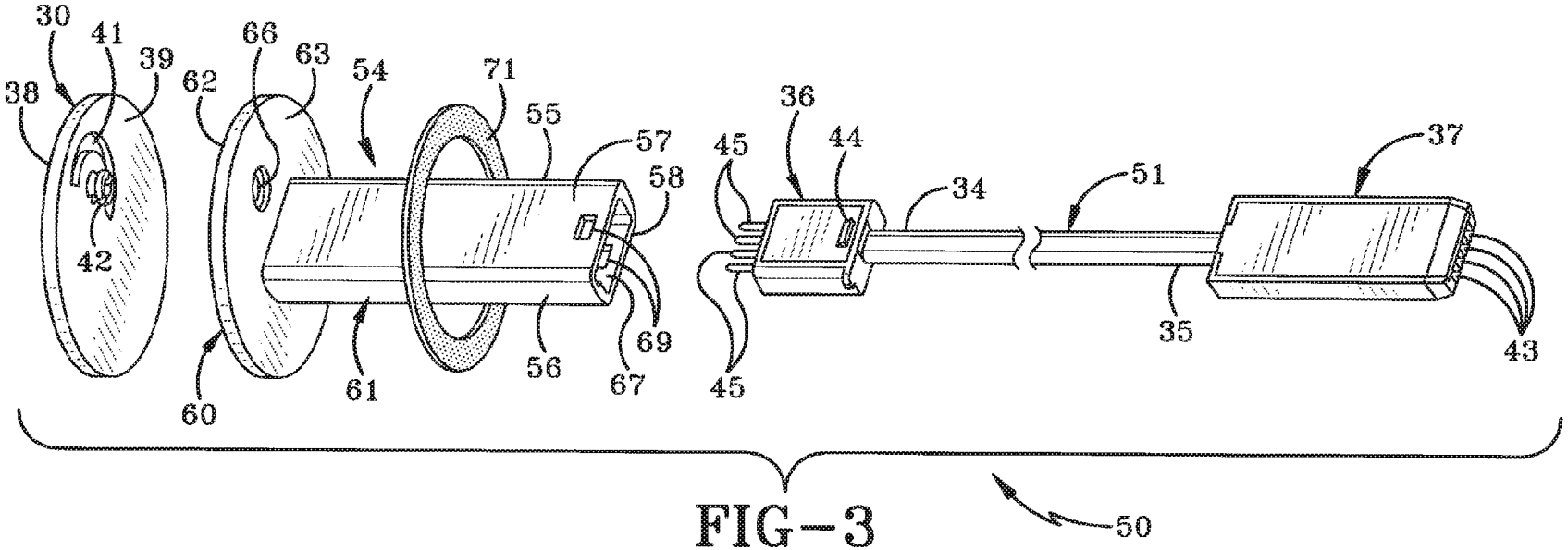
FIG. 3 illustrates an exploded view of the preferred embodiment of the of the key extension device for deactivating an alarm unit.
Figure 4:
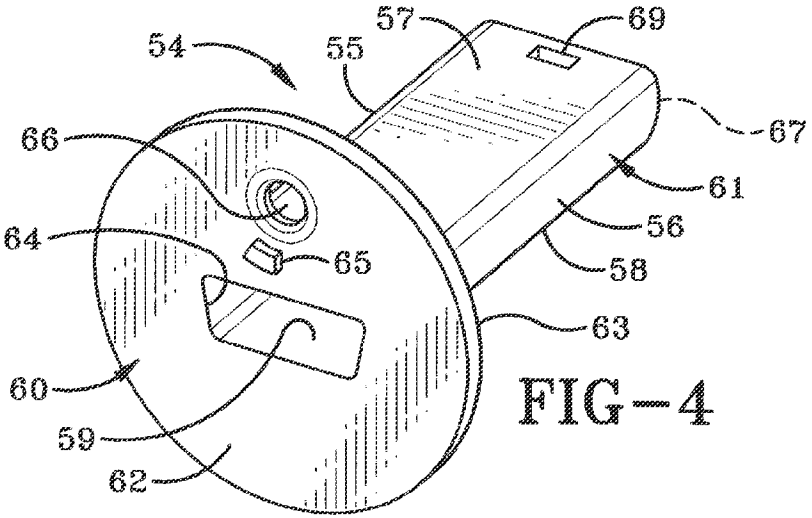
FIG. 4 illustrates a key extension cabinet portion of the preferred embodiment of a key extension device for deactivating an alarm unit.
Figure 8:
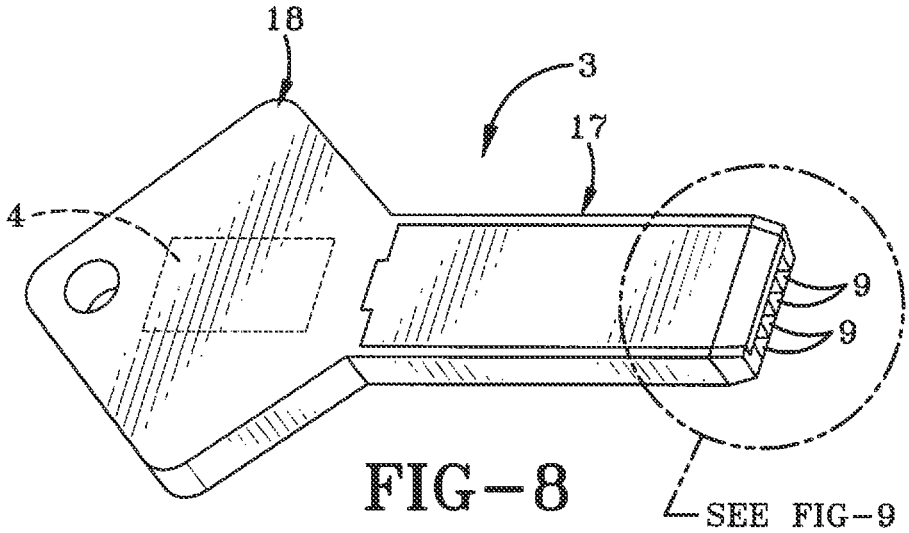
FIG. 8 illustrates a view of an electronic key associated with the preferred embodiment of a key extension device for deactivating an alarm unit.
Figure 9:
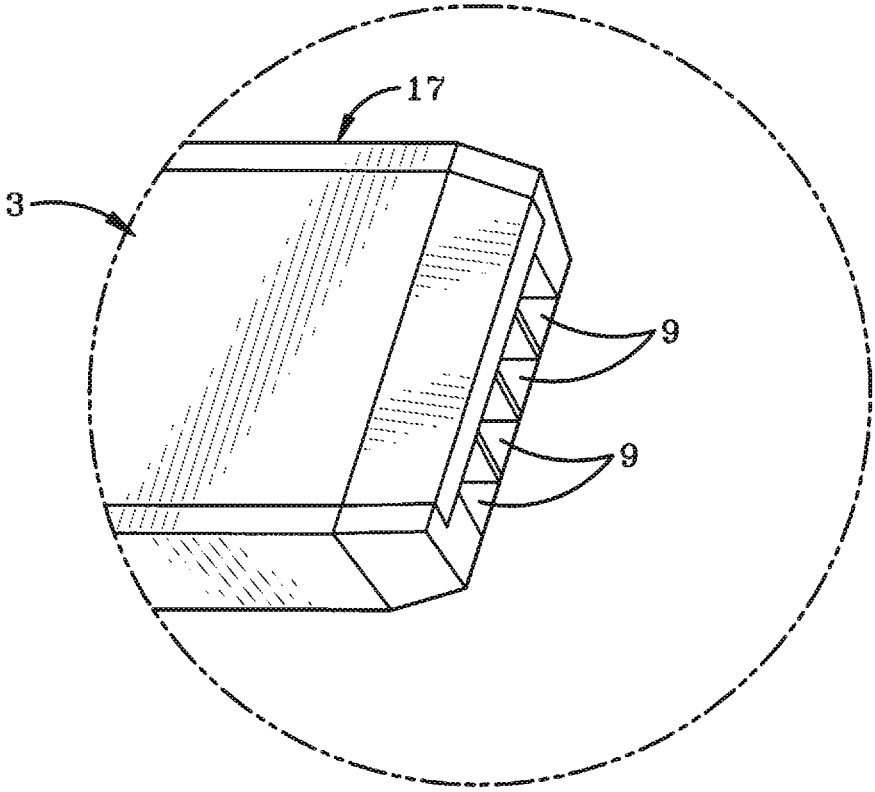
FIG. 9 illustrates a detailed view of the electronic key associated with the preferred embodiment of a key extension device for deactivating an alarm unit.

The preferred embodiment of the key extension device 50 is formed with the key extension cabinet portion 54 and a key extension cable 51 (e.g., electrical cable) that are best seen in FIG. 2-4. The key extension cabinet portion 54 includes an elongated key receptacle body 61 and a front plate 60. The key receptacle body 61 has a back end 67 and includes a left wall 55, a right wall 56, a top wall 57 and a bottom wall 58. These walls 55, 56, 57, 58 form an elongated chamber 59 for receiving an electronic key 3 (FIGS. 8-9). The electronic key 3 has a handle portion 18 and a body portion 17. The front plate 60 is formed with a front side 62, a back side 63 and an opening 64. A double sided adhesive (e.g., tape) may be between the display cabinet 2 and the front plate 60. The top edges of walls 55, 56, 57, 58 of the elongated key receptacle body 61 are adjacent to respective inner perimeter portions of the back side 63 of the front plate 60. The front plate 60 can further have a hole 66 and a tab 65 extending outwardly from the front side 62.

Figure 7:
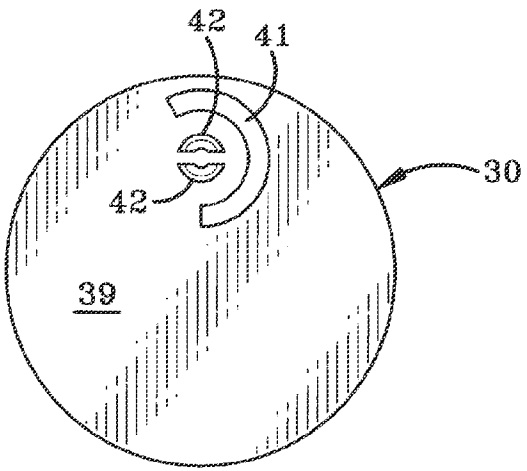
FIGS. 5-7 illustrate views of a cover of the key extension cabinet portion of the preferred embodiment of a key extension device for deactivating an alarm unit.
Figure 6:
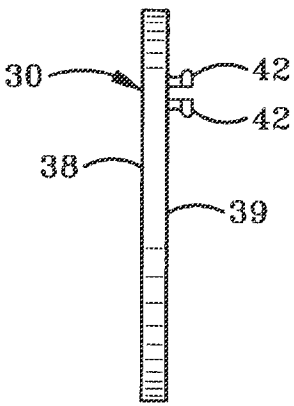
Figure 5:
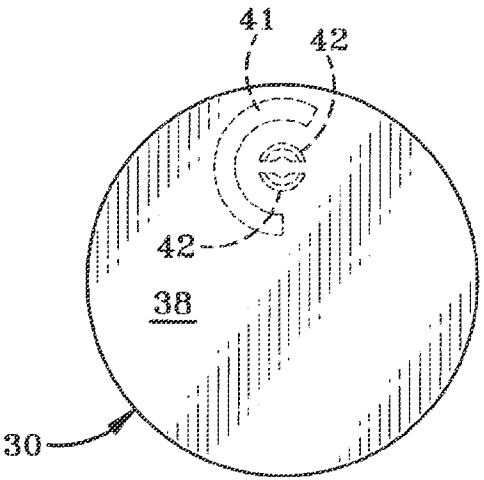
Figure 10:
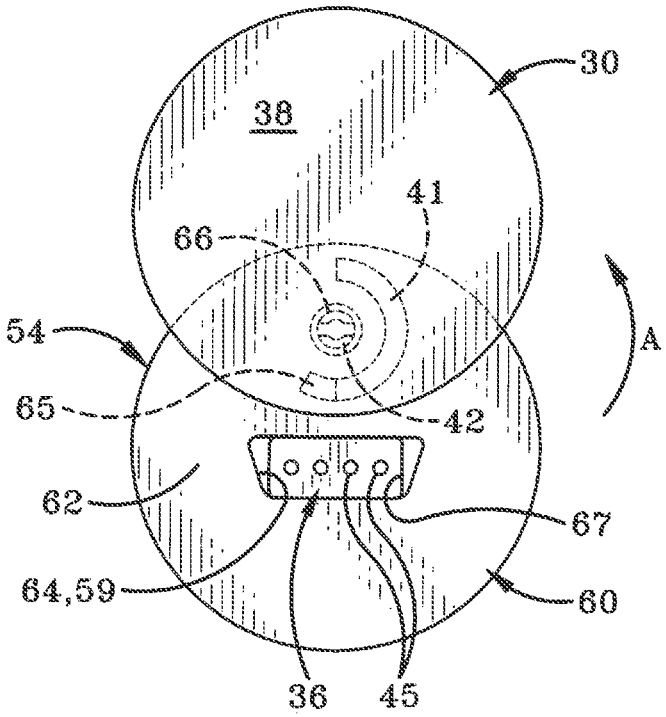
FIG. 10 illustrates the cover for the key extension cabinet portion in an open position.
Figure 11:
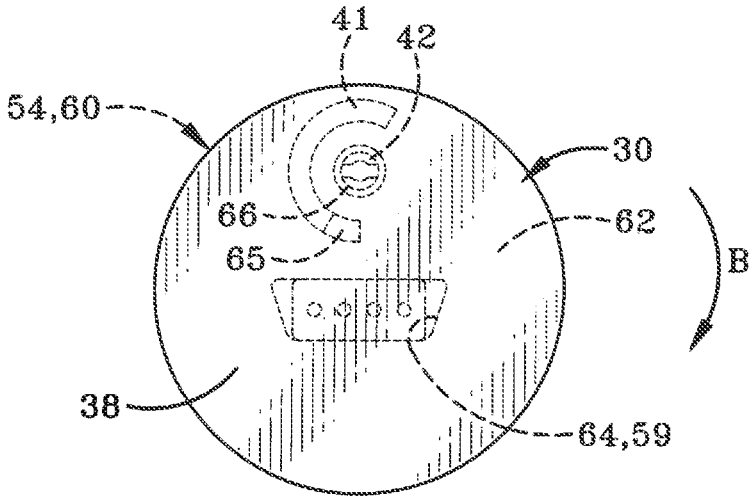
FIG. 11 illustrates the cover for the key extension cabinet portion in a closed position.

As shown in FIG. 5-7, a cover 30 can be formed with a similar perimeter shape as the outer perimeter of front plate 60 with a front surface 38 and a back surface 39. The cover 30 can be formed with a pair of snap tabs 42 extending outward from the back surface 39 and a semi-circular groove 41 extending inward from the back surface 39. The cover 30 can be placed over the front plate 60 to provide for a more attractive display system 1 when merchandise items 5 are on the display system 1 and there is no need to access the key extension device 50 with the electronic key 3. The cover 30 may be generally a flat circular disk shape. The snap tabs 42 of the cover 30 can be snapped into the hole 66 of the front plate 60 so that the tab 65 of the front plate is inside the semi-circular groove 41. This allows the cover 30 to be moved between a closed position (FIG. 11) and an open position (FIG. 10). In the closed position, the cover 30 covers the key extension device 50 and in the open position the cover 30 does not completely cover the key extension device 50 so that a key 3 may be inserted into the elongated key receptacle body 61. The cover 30 is moved from the closed position to the open position by pivoting the cover 30 in the direction of arrow A (FIG. 10). The cover 30 can be closed by pivoting the cover 30 in the direction of arrow B (FIG. 11).

In the preferred embodiment, the key extension cable 51 is connected between the alarm unit 10 and the key extension cabinet portion 54. The key extension cable 51 may include two or more wires with a first end 34 and a second end 35. The first end 34 can be a male type of connector 36 and the second end 35 is attached to a female type of connector 37. The extension cable 51 may be a four-wire ribbon type of cable that is connected between the two connectors 36, 37. Connector 37 is formed with holes 42 to allow connector 37 to accept pins of the key socket 52 at the alarm unit 10. Connector 36 has pins 45 extending outward for making electrical connections with an external key 3. Holes 9 in the electronic key 3 are configured to receive pins 45. Connector 36 additionally has tabs 44 that are receivable by openings 69 in the receptacle body 61. The extension cable 51 is configured to carry electrical signals between the alarm unit 10 and the key extension device 50.

In operation, when the alarm unit 10 is activated, it will begin monitoring the merchandise items 5 to detect if a merchandise item 5 is removed from its tether 24 or its tether 24 is cut. When either of these events occurs, the alarm unit 10 will sound an audio and/or a visual alarm to alert store personnel of a possible theft in progress. In another configuration of the preferred embodiment, there are no tethers 24 and the merchandise items 10 may be wirelessly tracked by the alarm unit 10. In this configuration, when a merchandise item 5 is determined to be moved a predetermined threshold distance from the alarm unit 10, the alarm unit 10 can generate one or more alarms. In another configuration, in addition to generating alarms at the display cabinet 2, the alarm unit 10 can send a message to other store computers or employee mobile devices indicating an alarm has been generated.

After an alarm has been generated, cover 30 of the key extension cabinet portion 54 can quickly be opened by a store employee and the electronic key 3 can be inserted in the direction of arrow C into the key extension device 50 as shown in FIG. 12. When contacts inside the electronic key 3 make contact with pins 46 at the connector 36 at the first end 34 of the key extension cable 51, the alarm unit 10 can then read a serial number out of an electronic circuit 4 in the electronic key 3. The alarm unit 10 can then compare this serial number to a list of authorized serial numbers and then deactivate the alarm or take other appropriate actions. The alarm unit 10 can log the serial number of the electronic key 3 with the time the key 3 was used and what actions were taken. This information can later be retrieved from the alarm unit 10 by an authorized person with the correct type of electronic key 3.

Different types of keys can be used with the display system 1. For example a "revision key" can be used by store management and auditing personnel. Each key of this type of key has its unique serial number making each key traceable to its corresponding key and serial number allowing these keys to be used across multiple store departments. A "program key" is an electronic key 3 that store management and auditing personnel can use to rapidly change key codes in the event of a key loss or changes in operating parameters. This can be accomplished simply by plugging this type of key into the key extension device and new parameters will be programmed into the alarm unit in a few seconds. A "memo key" is a service key for store management and auditing personnel to read data out of the alarm unit and into a memory chip on the key. Date read can include alarms, system operations and system messages with date and time. This can be used for analysis in cases of suspected internal theft, application errors and service operations.

In another configuration of the preferred embodiment, a fiber-optic cable 46 is connected between the key extension device 50 and the alarm unit 10. The fiber-optic cable 46 is configured to bring an infra-red signal from the key extension device 50 to an infra-red sensor in the alarm unit 10. In this configuration, the display system 1 allows a store employee to bring an infra-red remote control within proximity of the display cabinet 2. An infra-red signal from the remote control will be guided down the fiber-optic cable 46 to the alarm unit 10. The alarm unit 10 will detect this signal and switch off a sounding alarm. In this configuration, the alarm may be turned off three times or another fixed number of times before an alarm is required to be reset with the electronic key 3.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all of the illustrated blocks may be required to implement an example methodology. Blocks may be combined or separated into multiple components. Furthermore, additional and/or alternative methodologies can employ additional, not illustrated blocks.

Figure 13:
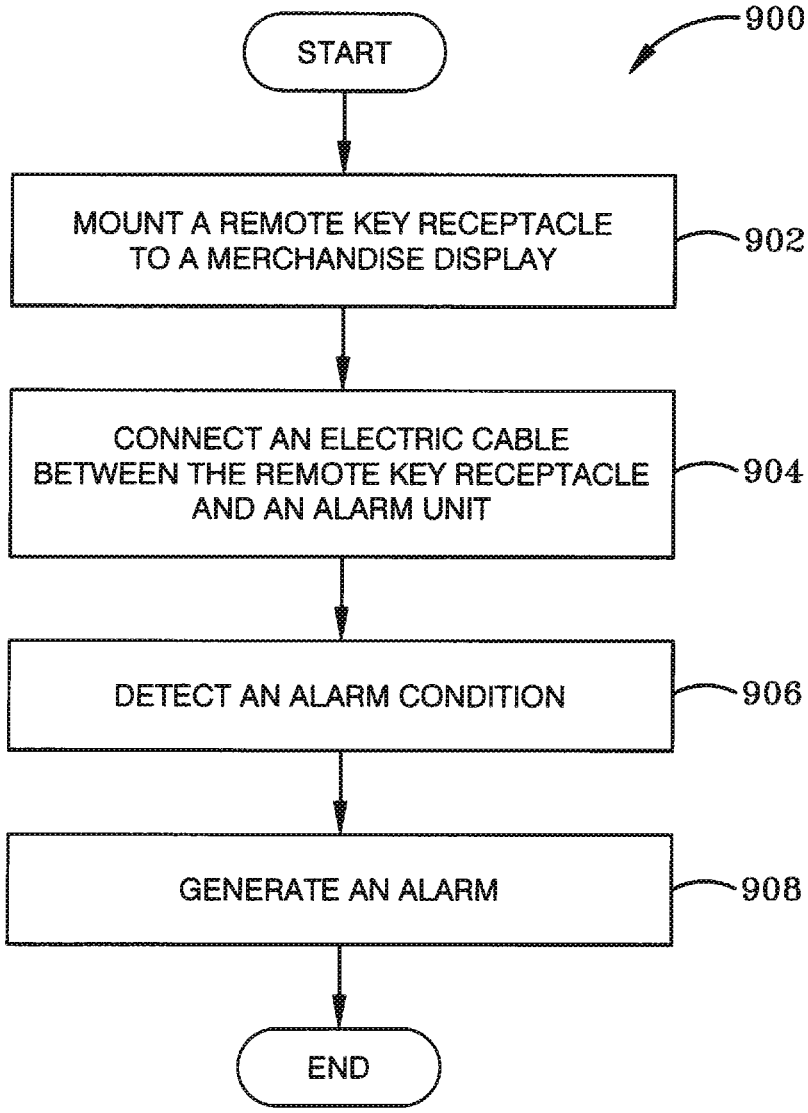
FIG. 13 illustrates an embodiment of a method for deactivating an alarm unit.

FIG. 13 illustrates a method 900 of protecting merchandise items at a merchandise display. The method 900 mounts a remote key receptacle to an outside wall of a merchandise display cabinet at 902. The remote key receptacle can receive an electronic key. An electrical cable is connected between the remote key receptacle and an alarm unit inside the merchandise display cabinet at 904. The cable transfers electronic signals from the electronic key to the alarm unit. This allows the key to easily be used to control the alarm unit rather than requiring the merchandise display to be opened and the key inserted directly into the alarm unit. An alarm condition is detected at the alarm unit at 906 when a merchandise item is being removed from the merchandise display. An alarm is generated at the alarm unit at 908 when the alarm condition is detected. This alerts store employees that a possible theft is in progress so that they may take appropriate actions.

After the alarm has been investigated, a key can be inserted into the remote key receptacle. Electrical signals that may indicate a serial number of the electronic key are transmitted from the key over the cable and to the alarm unit. The alarm unit will disable the alarm based, at least in part, on the electronic signals.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

The invention claimed is:

1. A system comprising:

a display cabinet configured to display a plurality of merchandise items;

a plurality of tethers, wherein each tether is configured to be attached to a respective merchandise item;

an alarm unit configured to generate an alarm in response to one of the merchandise items being removed from a respective tether or in response to a respective tether being cut; and a key extension device configured to be mounted away from the alarm unit and on an outer surface of the display cabinet, the key extension device being configured to carry signals from an electronic device to the alarm unit to control the alarm unit without opening the display cabinet.

2. The system of claim 1, wherein the electronic device is an electronic key or a remote control.

3. The system of claim 1, wherein the electronic device is an electronic key and wherein the key extension device includes a key socket that is configured to receive the electronic key.

4. The system of claim 1, wherein the electronic device is an electronic key and wherein the alarm unit is configured to receive the signals from the electronic key indicating a serial number of the electronic key.

5. The system of claim 1, wherein the electronic device is an electronic key and wherein the alarm unit is configured to receive the signals from the electronic key that place the alarm unit in a different operating mode.

6. The system of claim 1, wherein the electronic device is an electronic key and wherein the alarm unit is configured to receive the signals from the electronic key that deactivate the alarm unit.

7. The system of claim 1, wherein the electronic device is a remote control configured to provide the signals as infra-red signals, and wherein alarm unit includes an infra-red sensor.

8. The system of claim 1, wherein the electronic device is a remote control configured to provide the signals as infra-red signals, and wherein the key extension device includes a fiber-optic cable to the alarm unit.

9. An apparatus comprising:

a plurality of tethers, wherein the plurality of tethers includes a tether configured to be attached to a merchandise item to be displayed on a display cabinet;

an alarm unit configured to be placed inside the display cabinet and connected to the plurality of tethers, the alarm unit being further configured to generate an alarm in response to the merchandise item being removed from the tether or in response to the tether being cut;

an electronic device configured to provide signals that control the alarm unit; and a key extension device configured to be mounted away from the alarm unit and on an outer surface of the display cabinet, the key extension device being configured to carry the signals from the electronic device to the alarm unit to control the alarm unit without opening the display cabinet.

10. The apparatus of claim 9, wherein the electronic device is an electronic key or a remote control.

11. The apparatus of claim 9, wherein the electronic device is an electronic key and wherein the key extension device includes a key socket that is configured to receive the electronic key.

12. The apparatus of claim 9, wherein the electronic device is an electronic key and wherein the alarm unit is configured to receive the signals from the electronic key indicating a serial number of the electronic key.

13. The apparatus of claim 9, wherein the electronic device is an electronic key and wherein the alarm unit is configured to receive the signals from the electronic key that place the alarm unit in a different operating mode.

14. The apparatus of claim 9, wherein the electronic device is an electronic key and wherein the alarm unit is configured to receive the signals from the electronic key that deactivate the alarm unit.

15. The apparatus of claim 9, wherein the electronic device is a remote control configured to provide the signals as infra-red signals, and wherein alarm unit includes an infra-red sensor.

16. An apparatus comprising:

a key extension cabinet portion configured to be mounted on an outer surface of a display cabinet and away from an alarm unit that is placed inside the display cabinet, wherein the alarm unit is configured to generate an alarm in response to any one of a plurality of merchandise items being removed from a respective tether or in response to any one of a plurality of tethers being cut; and a key extension cable configured to be connected between the key extension cabinet portion and the alarm unit to carry signals from an electronic device to the alarm unit to control the alarm unit without opening the display cabinet.

17. The apparatus of claim 16, wherein the electronic device is an electronic key or a remote control.

18. The apparatus of claim 16, wherein the electronic device is an electronic key and wherein the key extension cabinet portion device includes a key socket that is configured to receive the electronic key.

19. The apparatus of claim 16, wherein the electronic device is an electronic key and wherein the alarm unit is configured to receive the signals from the electronic key that place the alarm unit in a different operating mode.

20. The apparatus of claim 16, wherein the electronic device is a remote control configured to provide the signals as infra-red signals, and wherein alarm unit includes an infra-red sensor.

* * * * *